US005336975A

United States Patent [19]

Goebel et al.

[11] Patent Number: 5,336,975

[45] Date of Patent: Aug. 9, 1994

[54] CROSSED-FIELD PLASMA SWITCH WITH HIGH CURRENT DENSITY AXIALLY CORROGATED CATHODE

[75] Inventors: Dan M. Goebel, Tarzana; Robert L. Poeschel, Thousands Oaks; Ronnie M. Watkins, Agoura, all of Calif.

[73] Assignee: Hughes Aircraft Company, Los Angeles, Calif.

[21] Appl. No.: 963,792

[22] Filed: Oct. 20, 1992

[51] Int. Cl.[5] ..... H01J 7/24

[52] U.S. Cl. ..... 315/111.41; 315/111.21; 315/344; 313/231.31

[58] Field of Search ..... 315/111.21, 111.41, 315/344, 338, 340; 313/161, 231.31, 359.1; 372/55, 83, 92

[56] References Cited

U.S. PATENT DOCUMENTS

| | | | |
|---|---|---|---|
| 4,247,804 | 1/1981 | Harvey | 315/344 |
| 4,367,553 | 1/1983 | Neracher | 372/55 |
| 4,596,945 | 6/1986 | Schumacher et al. | 315/344 |
| 5,019,752 | 5/1991 | Schumacher | 315/344 |
| 5,132,597 | 7/1992 | Goebel et al. | 315/344 |

FOREIGN PATENT DOCUMENTS

| | | |
|---|---|---|
| 0446072 | 9/1991 | European Pat. Off. . |
| 0473814 | 3/1992 | European Pat. Off. . |
| 8912905 | 12/1989 | PCT Int'l Appl. . |

OTHER PUBLICATIONS

*Cobine, "Thyratron", McGraw-Hill Encyclopedia of Electronics and Computers*, McGraw-Hill Inc., 1984, pp. 855–856.

*Primary Examiner*—Robert J. Pascal
*Assistant Examiner*—Haissa Philogene
*Attorney, Agent, or Firm*—V. D. Duraiswamy; W. K. Denson-Low

[57] ABSTRACT

A CROSSATRON plasma switch has a peak current capability in excess of 10kA and a switching speed of at least $1\times10^{11}$A/sec, making it compatible with the requirements of excimer and $CO_2$ gas laser switches, and yet is small enough to be mechanically integrated with such lasers. It employs an axially corrugated cathode with a body diameter on the order of 10 cm and shallow corrugations whose depths are about 1.0–1.5 times the distance between corrugations, together with a reduced diameter anode (of about 2.5 cm diameter for an excimer laser and about 1.25 cm diameter for a $CO_2$ laser), to obtain a plasma volume of about 50–100 $cm^3$ for rapid switching. A magnet assembly around the cathode uses only two stacked magnets, but has an overall greater axial length and surface magnetic strength than in prior switches. The magnet design produces a high field strength near the cathode, but without a significant extension of the field into the anode region.

29 Claims, 4 Drawing Sheets

CROSSED-FIELD PLASMA SWITCH WITH HIGH CURRENT DENSITY AXIALLY CORROGATED CATHODE

RELATED APPLICATION

This application is related to application Ser. No. 07/901,353, filed Jun. 19, 1992.

BACKGROUND OF THE INVENTION

1. Field of the Invention

This invention relates to grid-modulated plasma switches, generally referred to as CROSSATRON® switches, and to the operation of such switches at current levels of 10kA or greater.

2. Description of the Related Art

CROSSATRON switches are grid-modulated plasma switches capable of fast closing speeds like a thyratron, and of rapid opening like a vacuum tube. CROSSATRON is a registered trademark of Hughes Aircraft Company. A sequence of CROSSATRON designs are shown in U.S. Pat. No. 4,247,804 issued Jan. 27, 1981 to Harvey, U.S. Pat. No. 4,596,945 issued Jun. 24, 1986 to Schumacher et al. and U.S. Pat. No. 5,019,752 issued May 28, 1991 to Schumacher, all of which are assigned to Hughes Aircraft Company, the assignee of the present invention.

The principles of operation of a CROSSATRON switch are illustrated in FIG. 1. The switch is a hydrogen plasma device having four coaxial, cylindrical electrodes disposed around a center axis 2. The outermost electrode 4 is the cathode, which is surrounded by an axially periodic permanent magnet stack 6 to produce a localized, cusp magnetic field 8 near the cathode surface. The innermost electrode 10 functions as an anode, while the next outer electrode 12 is a control grid and the third outer electrode 14 is a source grid.

Secondary electrons produced at the cathode surface are trapped in the magnetic field, and travel in cycloidal $E \times B$ orbits (where E is the electric field and B is the magnetic field) around the cylindrical anode 10 due to the radial electric field and the axial component of the magnetic field. The electrons eventually lose their energy via collisions, and are collected by the anode or grids. The long path length of the electrons near the cathode surface enhances ionization of the hydrogen background gas, and reduces the pressure at which the switch operates (compared to thyratrons). The hydrogen pressure in the switch can range from 100 to 1,000 microns, depending upon the gap spacing between the electrodes and the voltage level. The cathode material is typically molybdenum, and no cathode heater power is required.

The source grid 14 is used to minimize turn-on jitter by maintaining a low level (typically less than 20mA) DC discharge to the cathode, while the control grid 12 is normally held within about 1kV of the cathode potential. When open, the high voltage in the switch is sustained across the gap between the control grid 12 and the anode 10. The switch is closed by pulsing the control grid to a voltage potential above that of the cathode, thereby building up the density of the plasma 16 so that it diffuses into the gap between the control grid 12 and the anode 10. The result is a low impedance conduction path between the cathode and anode, and a consequent closing of the switch. A high density plasma can be established in the switch, and the rate of current rise to the anode can be increased by prepulsing the source grid 14 at about 1 microsecond before the closing voltage pulse is applied to the control grid 12.

The CROSSATRON switch was originally developed as a closing-only switch (U.S. Pat. No. 4,247,804), but a modulator switch capable of high current interruption was also developed (U.S. Pat. No. 4,596,945). In U.S. Pat. No. 5,019,752 the cathode was provided with a series of chromium-plated circular grooves or corrugations that extended around the cathode axis. The corrugations increased the effective cathode surface area exposed to the plasma, and thereby reduced the electron emission current density from the chrome surface to minimize arcing.

A different approach to the use of cathode corrugations was disclosed in an application by the present inventors, "High Voltage Crossed-Field Plasma Switch" Ser. No. 07/901,353, filed Jun. 19, 1992 and assigned to Hughes Aircraft Company. The cathode corrugations in this application extend axially, rather than circumferentially as in the '752 patent, with the corrugation depths being at least twice their widths. When used in connection with a deuterium gas fill, switching voltages greater than 100kV and a peak closing current of 1kA were achieved, as compared with a peak closing current of about 250 amps with a more conventional flat cathode surface and hydrogen fill.

The current level achieved with the above switch was still not high enough to allow the switch to be used for laser discharge switching applications, such as those found in TE-$CO_2$ and excimer lasers. These applications require the switch to have a peak current capability of about 2.5–10kA, and also a closing speed greater than $2 \times 10^{10}$A/sec for $CO_2$ lasers and approximately $1 \times 10^{11}$A/sec for excimer lasers. At present, gas-discharge lasers utilize thyratrons, such I as described in Cobine, "Thyratron", *McGraw-Hill Encyclopedia of Electronics and Computers,* McGraw-Hill Inc., 1984, pages 855–856, and spark gaps. Since CROSSATRON switches have a much longer life than thyratron and spark-gap switches, plus similar fast closing speeds and much higher pulse-repetition-frequencies, it would be desirable to use CROSSATRON switches for gas laser systems. However, currently available CROSSATRON switches are limited to peak currents of 3kA or less. Attempts have been made to increase the peak current level by increasing the cathode diameter, and thus the electron-emitting area; switches with a peak current capability in excess of 10kA have been achieved by using cathode diameters in excess of 25 cm. Unfortunately, commercial lasers have a fixed diameter socket into which the switch must fit, and CROSSATRON switches with cathode diameters in excess of about 10 cm cannot be accommodated. Therefore, although the high current CROSSATRON switches that have been developed exhibit a peak current capability that is sufficient for laser switching, in practice they are much too large to be used for laser applications.

SUMMARY OF THE INVENTION

The present invention seeks to provide an improved CROSSATRON plasma switch that is capable of reliably operating with peak currents up to 10kA or greater, with a switching speed suitable for excimer and $CO_2$ lasers, and yet is compact enough to fit within the switch socket of a conventional excimer or $CO_2$ laser.

These goals are achieved with a novel CROSSATRON switch design having a number of features that actually run counter to prior teachings, but which in combination make possible a compact switch with a very high peak current capability and switching rate. The cathode employs axially directed corrugations, but the corrugations are shallower, not deeper, and more smoothly rounded at the tips than those in the application Ser. No. 07/901,353 even though the switch's ultimate current carrying capability is higher. Contrary to the prior application in which the corrugation depths are at least twice the width between corrugations, in the present invention the corrugation depths are preferably between 1.0 and 1.5 times the distance between corrugations. The shallower corrugations make it possible to maximize the plasma volume to the range of 50–100 $cm^3$ in a small diameter switch, which in turn yields switching speeds of $10^{11}$A/sec or better, while the rounded edges increase the current density capability before arcing occurs.

The available plasma volume is also enhanced by reducing the anode diameter significantly below the 6.4 cm diameter previously used with a 10 cm diameter cathode. While a lower limit to the anode diameter is imposed to prevent Paschen breakdown, it has been found that an anode diameter as small as 2.5 cm can be used for an excimer laser, if combined with the other design features of the invention. An even smaller anode diameter of 1.25 cm can be attained with the somewhat lower peak current required for a $CO_2$ laser. With an excimer laser the anode is preferably formed from the same material as the cathode, i.e., molybdenum. This counteracts an anode sputtering effect associated with a high negative anode voltage spike at the end of each excimer laser pulse that causes ion bombardment and sputtering of the anode.

The magnet design is also modified to achieve the high current density. To provide an adequate magnetic field $B_z$ along the switch axis (greater than 300 Gauss) at the tips of the corrugations for confining the electrons and producing plasma, and yet keep the magnetic field strength low enough (less than 200 Gauss) in the gap between the anode and control grid to prevent significant plasma generation and switch latching, the magnets are both lengthened and increased in strength compared to prior CROSSATRON switches and moved further away from the control grid by increasing the cathode-to-control grid spacing. The magnets surrounding a 10 cm diameter cathode are preferably about 2.5–3 cm long in the axial direction, and have a surface strength of about 1.2–2.4 kG. Also, only two stacked magnets are used to produce a single plasma ring in the switch, rather than multiple magnet layers and multiple plasma rings as in prior designs.

These and other features and advantages of the invention will be apparent to those skilled in the art from the following detailed description, taken together with the accompanying drawings.

DETAILED DESCRIPTION OF THE INVENTION

Figure 3:
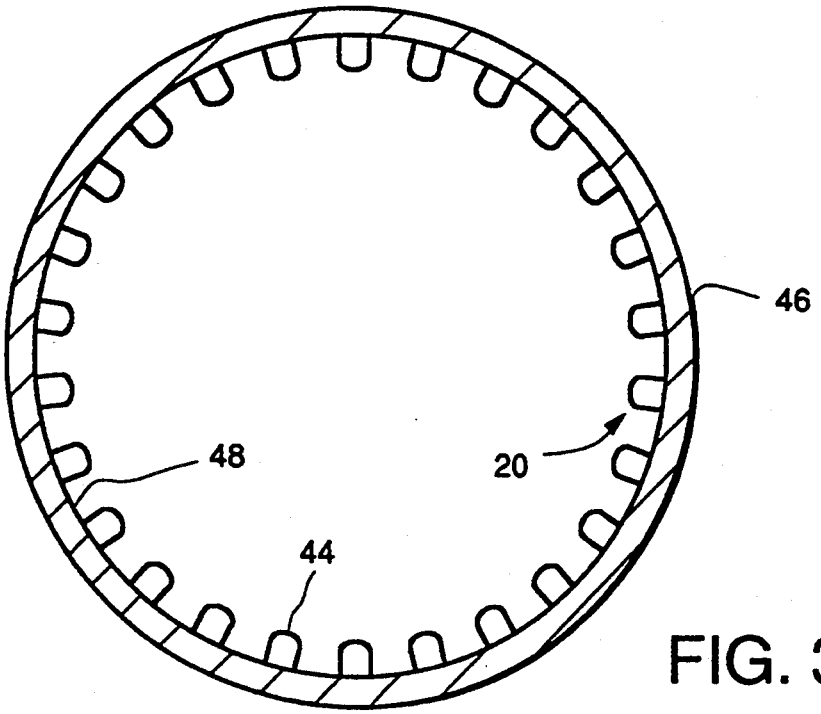
FIG. 3 is a sectional view of a preferred cathode configuration, taken normal to the cathode's axis.
Figure 2:
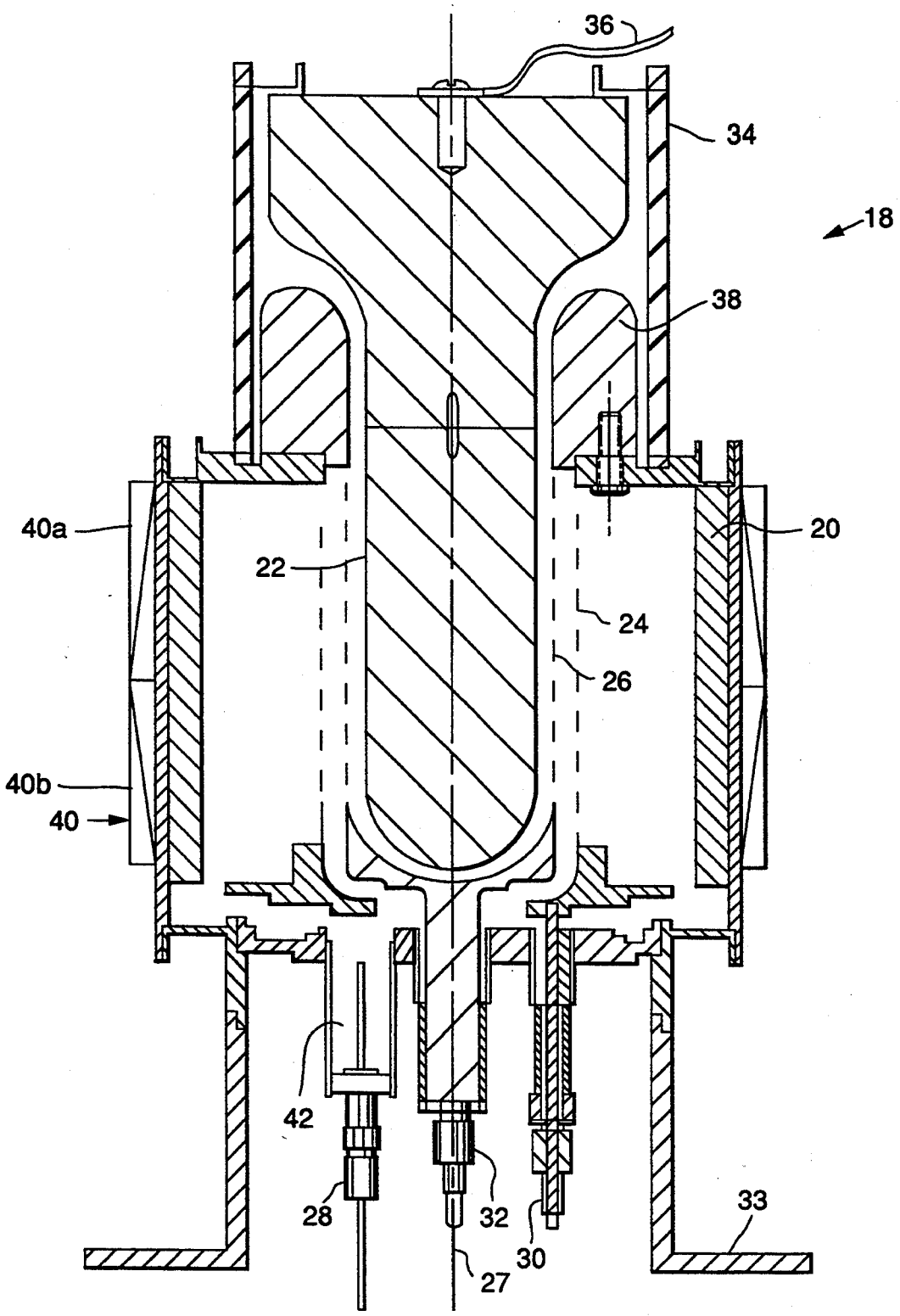
FIG. 2 is a sectional view of a CROSSATRON switch in accordance with the invention.

A cross-section of a CROSSATRON switch that is constructed in accordance with the invention to provide a high peak current capability and a rapid switching speed is shown in FIG. 2. A vacuum housing 18 for the switch includes a generally cylindrical cathode 20 that encircles and is radially spaced outward from an anode cylinder 22. Axial corrugations on the cathode are described below in connection with FIG. 3. A source grid 24 and control grid 26 extend annularly around anode 22, inward from cathode 20. The cathode, anode and grids are arranged coaxially about a central axis 27. Electrical connectors 28, 30 and 32 are provided for the reservoir heater, source grid and control grid, respectively, while a cathode connection is made via a base flange 33. The anode 22 is mechanically suspended from a ceramic bushing 34, and is supplied with voltage signals via an electrical connector 36. An upper cathode extension 38, referred to as the Paschen shield, surrounds the upper portion of the anode to prevent the formation of a large gap between the anode and cathode that might otherwise result in Paschen breakdown. Permanent magnets 40 are positioned on the outer cathode wall. A hydrogen gas fill for the interior of the switch is provided from a reservoir 42.

For laser discharge applications, high peak currents (>2.5kA) at high current rate-of-rise ($>2\times10^{10}$A/sec) are required. This means that a high density plasma must be generated in the switch very rapidly, which in turn requires a high ionization rate. To the first order, the rate of ionization in the switch is directly proportional to both the neutral gas pressure in the switch and the switch volume where ionization can occur; this volume is considered to be the space between the cathode and source grid where primary electrons are confined. It has been discovered that compact, smaller volume switches require significantly higher gas pressures than do larger volume switches for the same current rise rates. With the described switch at voltages of about 40kV, however, in which the cathode diameter is preferably about 10 cm, the hydrogen gas fill pressure is limited to about 600–700 microns pressure by Paschen breakdown. Within this pressure regime it has been determined that a volume plasma of 50–100 $cm^3$ is required to achieve a $1\times10^{11}$A/sec switching rate as required by excimer lasers.

A unique cathode design has been developed that, together with the other features of the invention described herein, realizes the higher peak current capability potential of axially corrugated cathodes, and yet provides a greater plasma volume to enhance the switching rate. A sectional view showing the preferred cathode structure is presented in FIG. 3. The cathode 20 has a generally cylindrical shape, and is formed as a series of corrugations 44 that project inward towards the cathode axis. The corrugations extend axially (into the page as viewed in FIG. 3), and are preferably formed by folding a sheet of molybdenum into a corrugated structure and spot welding or brazing it to an outer hollow stainless steel support cylinder 46. The corrugations provide both a large cathode area, and a large plasma generation region in the spaces between corrugations. The inward end of the corrugations are fully rounded to prevent arcing.

The circulating electrons do not enter into the spaces between the corrugations 44, and accordingly the outer limit of the effective plasma volume is defined by the rounded ends of the corrugations. In accordance with the invention, the corrugations are made significantly shallower than in application Ser. No. 07/901,353, and yet the permissible current density before arcing begins with a hydrogen fill gas, is increased to the order of 100A/cm$^2$, as opposed to the prior maximum current density with a deuterium gas fill of about 10A/cm$^2$. The depths of the corrugations 44 (their inward projection from the cathode base circumference 48 to the tips of the corrugations) are preferably between 1 and 1.5 times the distance between corrugations. For a 10 cm diameter cathode the corrugations are preferably about 5–7 mm deep and spaced about 4–6 mm apart, with a cathode axial length of about 2.5–3 cm; in a specific embodiment the corrugations were about 6 mm deep, with a distance of about 4.8 mm between adjacent corrugations and a cathode length of about 2.6 cm. By thus making the corrugations shallower but still retaining a sufficient cathode area for high current operation, the effective plasma volume can be expanded to a level at which the switching rate required by excimer lasers is achieved, without having to extend the cathode's base diameter beyond the 10 cm range that makes the switch mechanically compatible with a laser socket.

A new anode design is also provided to increase the plasma volume. As compared to an anode diameter of about 6 cm for the prior CROSSATRON switch of application Ser. No. 07/901,353, it has been found that the anode can be reduced to about 2.5 cm in diameter with a hydrogen pressure of 600–700 microns, a plasma-contacting axial length of 2 cm (centered between the 2 magnet rows) to produce 10kA peak current. Reducing the anode 22 diameter allows the diameters of the source and control grids 24 and 26 to be similarly reduced, to about 3.6 cm and 3.0 cm respectively. The reduction in the source grid diameter, coupled with the shallower cathode corrugations, results in the necessary plasma volume for excimer laser switching. This approach of dimensional contraction is in direct contrast to the prior tendency to increase the switch size for greater current handling capability.

A lower limit on the permissible anode size is imposed by the need to retain a sufficient anode area to conduct the electron current density. Over half of the current in CROSSATRON switches is carried by plasma electrons flowing to the anode. For an excimer laser switch the minimum reliable anode diameter was found to be about 2.5 cm. For the lower peak currents associated with $CO_2$ lasers, the anode diameter can be further reduced to about 1.25 cm. This further reduction again increases the plasma volume (by permitting a reduction in the source and control grid diameters), and also allows for a significant material savings.

The anodes of prior CROSSATRON switches were typically constructed from copper or stainless steel, which provided good heat transfer characteristics, were easy to machine and were relatively inexpensive. However, as indicated above the prior CROSSATRON switches were not suitable for gas laser switching. In an under-damped excimer laser circuit a large negative voltage spike of up to about 20 kV hits the anode at the end of each pulse. This negative voltage spike attracts ions, which sputter the anode surface material onto the cathode and grids. However, since the cathode is typically formed from molybdenum rather than copper or stainless steel because of molybdenum's high current density capability, sputtering of the dissimilar anode material onto the cathode surface can result in arcing at the high operating levels contemplated by the invention. Accordingly, the switch anode is also formed from molybdenum for excimer laser applications, to inhibit such arcing. Molybdenum anodes have previously been used for vacuum tubes to prevent anode arcing and melting during faults, but there is no anode arcing problem with the CROSSATRON switch. Rather, molybdenum is employed for the anode in the excimer laser version of the invention because of its sputtering onto the cathode. Very little negative voltage is applied to the anode when the switch is used with a $CO_2$ laser, and stainless steel or copper anodes can sometimes be used for that application.

The magnets 40 are also specially designed so that plasma is produced at a very high rate for rapid switch closing. A relatively high magnetic field, preferably well in excess of 300 Gauss measured in the direction of the axis of the tube, is required at the inner edges of the corrugations to produce the high plasma density required by high current laser switches. However, if the magnetic field strength in the anode gap (the area between the anode and the control grid) is too high (greater than about 200 Gauss), the switch can unintentionally latch closed because plasma is generated by an $E \times B$ discharge in this region. The desired gradient in magnetic field strength is achieved with a unique combination of magnetic strength, axial dimension, radial spacing between the magnets and the grids, and number of magnets used.

Figure 1:
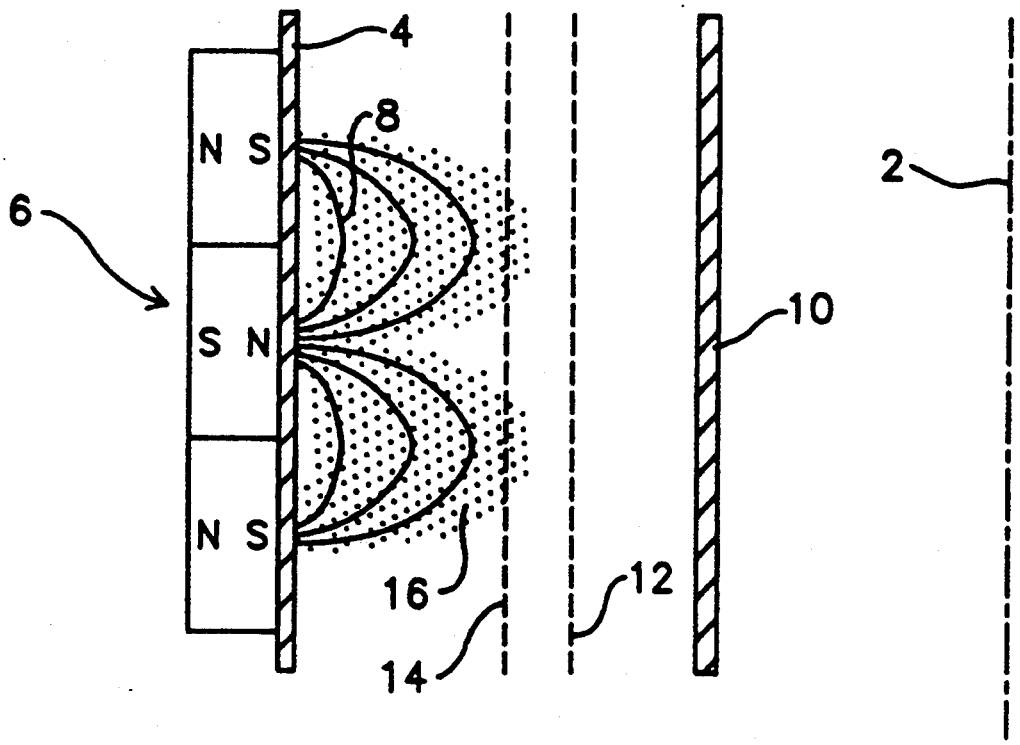
FIG. 1. (PRIOR ART)
FIG. 1 is a diagram illustrating the operation of a prior CROSSATRON switch, described above.

The surface strength of the magnets 40 is increased to obtain a greater magnetic field strength at the tips of the cathode corrugations, and the length of the magnets parallel to the system axis is increased so that the magnetic field cusp extends further inward towards the system axis, and thus takes into account the smaller anode diameter employed in the invention. Specifically, as opposed to prior ceramic magnets of about 800 Gauss surface strength and about 2.2 cm long, the invention employs magnets that have a surface strength of about 1.2–2.4kG and a length of approximately 2.5–3 cm; in a demonstration, the actual magnetic surface strength was 1.67kG and the length was 2.5 cm. Furthermore, in contrast to the prior practice of stacking three or more magnets, the present invention stacks only two magnets 40*a* and 40*b* to form the overall magnet structure 40. The prior use of three stacked magnets produced a double cusp in the magnetic field, as indicated in FIG. 1. However, it has been found that for current levels above 1kA almost all of the plasma is pushed down by the $E \times B$ field to the lower cusp. Thus, since the uppermost of the three prior magnets does not significantly influence the plasma distribution when used at the high current levels contemplated by the invention, it is simply omitted.

Figure 4:
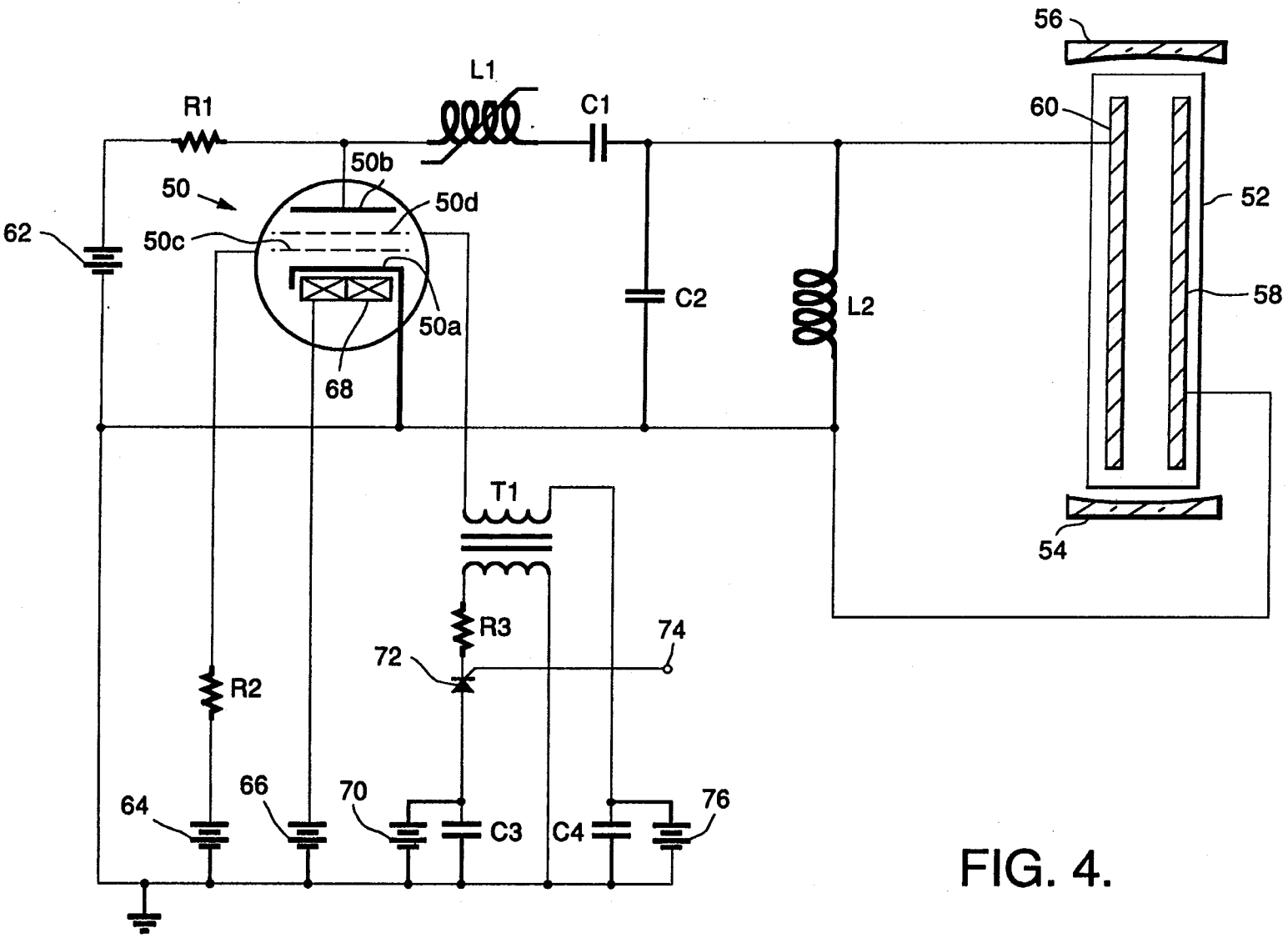
FIG. 4 is a schematic diagram showing the switch used with a gas laser.

FIG. 4 is a simplified schematic diagram showing the use of the new CROSSATRON switch 50 in a discharge circuit for a gas laser. The laser includes a discharge tube 52 that contains the gaseous lasing medium and defines a resonator cavity, a fully reflective mirror 54 at one end of the discharge tube, and a partially reflective mirror 56 at the other end of the tube. Anode and cathode plates 58 and 60 extend along opposite sides of the discharge chamber, out of the lasing path.

A self-regulating power supply 62 with a suitable laser discharge voltage capacity, such as 40kV, is connected through a charging resistor R1 and a saturable reactor L1 to charge a pulse storage capacitor C1. A discharge capacitor C2 and charging inductor L2 are connected in parallel with the laser cavity electrodes 58 and 60, between the far side of the pulse storage capacitor C1 and the switch cathode 50*a*. The switch anode 50*b* is connected between the charging resistor R1 and the saturable reactor L1. In operation, when the switch is open the power supply 62 charges the pulse storage capacitor C1 through the charging resistor R1 and saturable reactor L1. The charging inductor L2 has a low impedance on the charging time scale and completes the charging circuit. When the switch closes, it completes a two-capacitor ringing circuit for capacitors C1 and C2. The pulse storage capacitor C1 discharges into the discharge capacitor C2, and capacitor C2 in turn discharges very rapidly into the laser to produce a pumping action. The ringing circuit includes the saturable reactor L1, where the reactor's core saturates and its inductance drops when the closing current has built up to about 100A. The saturable reactor provides some impedance to the switch when it first closes, thereby eliminating a potential stalling problem, but after the initial portion of the closing cycle the reactor's inductance has dropped enough to allow rapid charging of the pulse storage capacitor C1. Although it presents a low impedance during the capacitor charging period, the charging inductor L2 appears essentially as an open circuit to the short discharge pulse from pulse storage capacitor C1, and thus does not interfere with the charging of discharge capacitor C2.

The operational circuitry for the switch 50 includes a power supply 64 that is connected through a resistor R2 to maintain a fairly low "keep alive" voltage on the source grid 50*c*, and another power supply 66 that provides a heating current to a heater 68 for the switch's gas reservoir. The control grid 50*d* is operated by a pulse from a control pulse capacitor C3, which is recharged by a power supply 70. A silicon controlled rectifier (SCR) 72 is triggered by a low voltage pulse applied to its control terminal 74 to complete a circuit (through resistor R3) between the control pulse capacitor C3 and the control grid 50*d*; a pulse transformer T1 isolates the remainder of the control grid circuitry from voltage pulses that occur in the switch upon closing. A bias capacitor C4 and parallel power supply 76 are connected to the control grid 50*d* side of the transformer to apply a small negative bias to the control grid between pulses—this prevents the switch from inadvertently turning itself on during the capacitor recharge cycle in case of residual plasma existing in the switch. Suitable values for the various circuit components are:

| | | | |
|---|---|---|---|
| R1 | 1 kohm | power supply 62 | 40 kV |
| R2 | 5 kohm | power supply 64 | 500 V |
| R3 | 5 kohm | power supply 66 | 2.5 V |
| L2 | 100 μH | power supply 70 | 1 kV |
| C1 | 22 nf | power supply 76 | −150 V |
| C2 | 28 nf | | |
| C3 | 100 nf | | |
| C4 | 2 μf | | |

Figure 5:
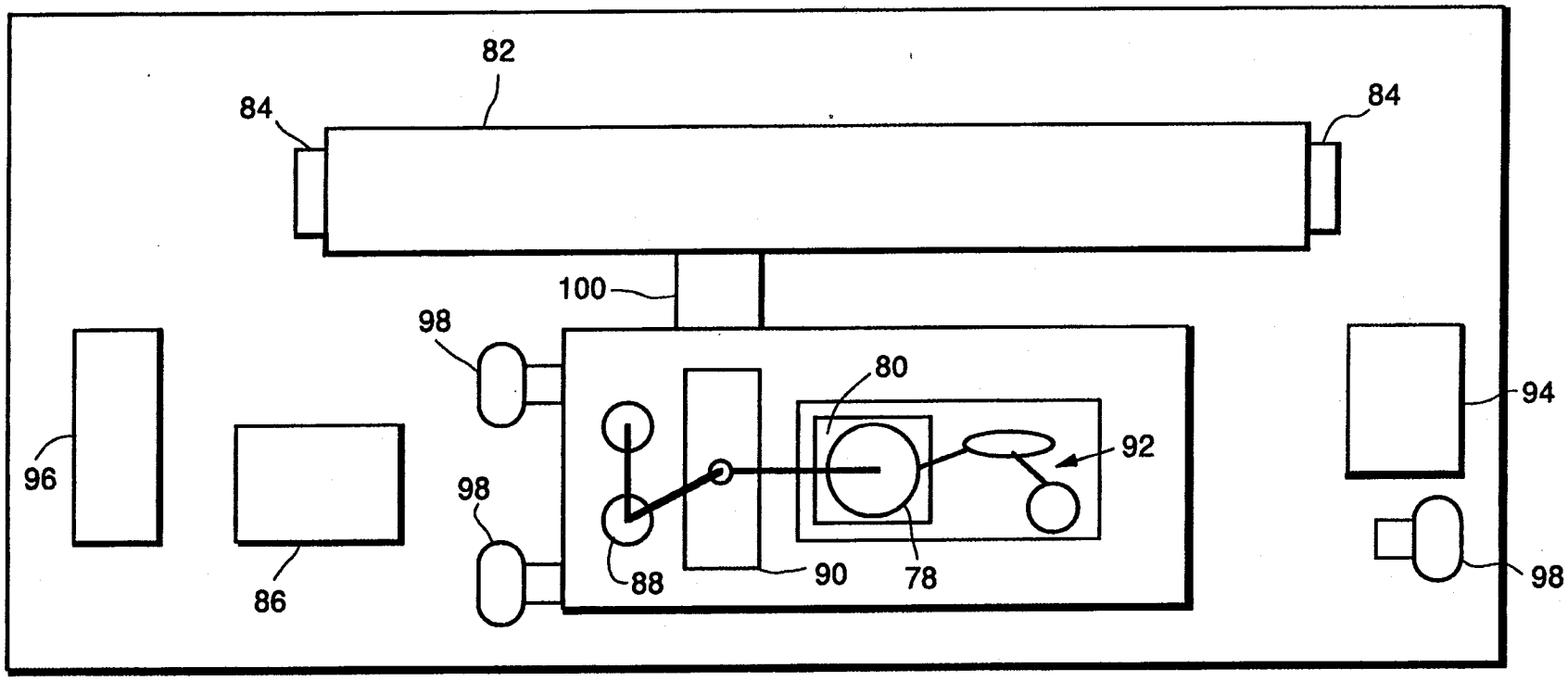
FIG. 5 is a simplified plan view of a laser with a compact CROSSATRON switch in accordance with the invention positioned in the laser's switch socket.

FIG. 5 is a simplified mechanical drawing showing a CROSSATRON switch 78 of the present invention mounted in the switch socket 80 of a conventional excimer laser system. The visible elements of the laser system include a laser cavity 82 with reflectors 84 at either end, a high voltage power supply 86, charging system 88, capacitor 90, grid drive 92 and heater power supply 94. A blower 96 and fans 98 are provided to cool the electrical components, which are connected to the laser cavity electrodes by a low inductance interconnect 100. The switch's 10 cm cathode diameter allows it to be mounted without arcing to other elements of the laser housing. It includes a flanged bracket at its lower end that is bolted to the socket floor.

While illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A plasma switch, comprising:

a vacuum housing, a generally cylindrical cold cathode within said housing providing a source of secondary electrons, the interior surface of said cathode comprising generally axially extending corrugations that project inward from an outer base surface and have rounded outer edges, a generally cylindrical anode disposed coaxially inward of the cathode and having a diameter less than half the diameter of said cathode base surface, a generally cylindrical source grid coaxially disposed between said anode and cathode, means for introducing an ionizable gas into the space between the cathode and source grid, said cathode and source grid maintaining a plasma therebetween in response to a predetermined voltage differential between them, a generally cylindrical control grid disposed between said source grid and anode for selectively enabling a plasma path between the cathode and anode, and thereby closing the switch, in response to a control voltage signal applied to the control grid, and magnet means for producing a magnetic field that extends into the area between the cathode and source grid and, in cooperation with a predetermined voltage differential between said cathode and source grid, causes secondary electrons from said cathode to follow cycloidal orbits in said area that do not substantially enter said corrugations, said axially corrugated cathode having a greater current density capability in said plasma switch than a cathode of similar diameter but with a smooth electron emitting surface.

2. The plasma switch of claim 1, wherein the depths of said cathode corrugations are less than 1.5 times the distance between said corrugations.

3. The plasma switch of claim 1, said corrugated cathode and anode defining a volume between them of at least 50 $cm^3$.

4. The plasma switch of claim 3, wherein said corrugated cathode extends axially a distance of about 2.5–3.0 cm.

5. The plasma switch of claim 1, wherein said magnet means establishes an axial magnetic field substantially greater than 300 Gauss at the inward ends of said corrugations, and substantially less than 200 Gauss at said control grid.

6. The plasma switch of claim 5, said secondary electron cycloidal orbits concentrating said plasma in a plasma concentration area, wherein said magnet means comprises only two stacked magnets that produce a single magnetic field cusp that is concentrated in the area of plasma concentration.

7. The plasma switch of claim 5, wherein the depths of said cathode corrugations are less than 1.5 times the distance between said corrugations.

8. The plasma switch of claim 1, wherein said cathode and anode are formed from the same type of material.

9. The plasma switch of claim 8, wherein said cathode and anode are formed from molybdenum.

10. A plasma switch, comprising:

a vacuum housing, a generally cylindrical cold cathode within said housing providing a source of secondary electrons, the interior surface of said cathode comprising generally axially extending corrugations that project inward from an outer base surface, the ratio of the corrugation depths to the distance between corrugations being in the approximate range of 1.0–1.5, a generally cylindrical anode disposed coaxially inward of the cathode, a generally cylindrical source grid coaxially disposed between said anode and cathode, said cathode and source grid defining a volume between them of about 50–100 $cm^3$, means for introducing an ionizable gas into the space between the cathode and source grid, said cathode and source grid maintaining a plasma therebetween in response to a predetermined voltage differential between them, a generally cylindrical control grid disposed between said source grid and anode for selectively enabling a plasma path between the cathode and anode, and thereby closing the switch, in response to a control voltage signal applied to the control grid, and magnet means for producing a magnetic field that extends into the area between the cathode and source grid and, in cooperation with a predetermined voltage differential between said cathode and source grid, causes secondary electrons from said cathode to follow cycloidal orbits in said area that do not substantially enter said corrugations, said axially corrugated cathode having a greater current density capability in said plasma switch than a cathode of similar diameter but with a smooth electron emitting surface.

11. The plasma switch of claim 10, wherein said magnet means establishes an axial magnetic field substantially greater than 300 Gauss at the inward ends of said corrugations, and substantially less than 200 Gauss at said control grid.

12. The plasma switch of claim 10, wherein said cathode and anode are formed from the same type of material.

13. The plasma switch of claim 11, wherein said cathode an anode are formed from molybdenum.

14. A plasma switch, comprising:

a vacuum housing, a generally cylindrical cold cathode within said housing providing a source of secondary electrons, the interior surface of said cathode comprising generally axially extending corrugations that project inward from an outer base surface by about 0.5–0.7 cm and with a distance of about 0.4–0.6 cm between corrugations, said outer base surface having a diameter on the order of 10 cm, a generally cylindrical anode disposed coaxially inward of the cathode, said anode having a diameter less than half the diameter of said cathode base surface, a generally cylindrical source grid coaxially disposed between said anode and cathode, said cathode and source grid defining a volume between them of about 50–100 $cm^3$, means for introducing an ionizable gas into the space between the cathode and source grid, said cathode and source grid maintaining a plasma therebetween in response to a predetermined voltage differential between them, a generally cylindrical control grid disposed between said source grid an anode for selectively enabling a plasma path between the cathode and anode, and thereby closing the switch, in response to a control voltage signal applied to the control grid, and magnet means for producing a magnetic field that extends into the area between the cathode and source grid and, in cooperation with a predetermined voltage differential between said cathode and source grid, causes secondary electrons from said cathode to follow cycloidal orbits in said area that do not substantially enter said corrugations, said axially corrugated cathode having a greater current density capability in said plasma switch than a cathode of similar diameter but with a smooth electron emitting surface.

15. The plasma switch of claim 14, said magnet means comprising a series of magnets that extend around the cathode for an axial length of about 2.5–3.0 cm and have a magnetic strength of about 1.2–2.4 KGauss.

16. The plasma switch o claim 15, wherein said magnets extend of an axial length of about 2.5 cm and have a magnetic strength of about 1.6–1.75K Gauss.

17. The plasma switch of claim 16, said secondary electron cycloidal orbits concentrating said plasma in a plasma concentration area, wherein said magnet means comprises only two stacked magnets that produce a single magnetic field cusp that is concentrated in the area of plasma concentration.

18. The plasma switch of claim 13, wherein said cathode and anode are both formed from molybdenum.

19. A laser system, comprising:

a laser housing that includes a switch socket, a laser resonator cavity within said housing, electrodes for initiating an electrical discharge within said resonator cavity to pump a gas therein, and a switch that controls the energization of said electrodes and is lodged within said switch socket, said switch comprising:

a vacuum housing, a generally cylindrical cold cathode within said vacuum housing providing a source of secondary electrons, the interior surface of said cathode comprising generally axially extending corrugations that project inward from an outer base surface by about 0.5–0.7 cm and with a distance of about 0.4–0.6 cm between corrugations, said outer base surface having a diameter on the order of 10 cm, a generally cylindrical anode disposed coaxially inward of the cathode, said anode having a diameter less than half the diameter of said cathode base surface, said cathode and anode being connected to complete a discharge circuit for said laser electrodes when the switch is closed, a generally cylindrical source grid coaxially disposed between said anode and cathode, said cathode and source grid defining a volume between them of about 50–100 $cm^3$, means for introducing an ionizable gas into the space between the cathode and source grid, said cathode and source grid maintaining a plasma therebetween in response to a predetermined voltage differential between them, a generally cylindrical control grid disposed between said source grid and anode for selectively enabling a plasma path between the cathode and anode, and thereby closing the switch, in response to a control voltage signal applied to the control grid, and magnet means for producing a magnetic field that extends into the area between the cathode and source grid and, in cooperation with a predetermined voltage differential between said cathode and source grid, causes secondary electrons from said cathode to follow cycloidal orbits in said area that do not substantially enter said corrugations, said axially corrugated cathode having a greater current density capability in said plasma switch than a cathode of similar diameter but with a smooth electron emitting surface.

20. The laser system of claim 19, said laser comprising an excimer laser, wherein the diameter of said anode is on the order of 2.5 cm.

21. The laser system of claim 20, wherein said cathode and anode are both formed from molybdenum.

22. The laser system of claim 19, said laser comprising a $CO_2$ laser, wherein the diameter of said anode is on the order of 1.25 cm.

23. The laser system of claim 19, said magnet means comprising a series of magnets that extend around the cathode for an axial length of about 2.5–3.0 cm and have a magnetic strength of about 1.2–2.4k Gauss.

24. The laser system of claim 23, said secondary electron cycloidal orbits concentrating said plasma in a plasma concentraton area, wherein said magnet means comprises only two stacked magnets that produce a single magnetic field cusp that is concentrated in the area of plasma concentration.

25. The plasma switch of claim 2, wherein said corrugations are wider than they are deep.

26. The plasma switch of claim 10, wherein said corrugations are wider than they are deep.

27. The plasma switch of claim 10, said secondary electron cycloidal orbits concentrating said plasma in a plasma concentration area, wherein said magnet means comprises only two stacked magnets that produce a single magnetic field cusp that is concentrated in the area of plasma concentration.

28. The plasma switch of claim 14, wherein said corrugations are wider than they are deep.

29. The plasma switch of claim 19, wherein said corrugations are wider than they are deep.

* * * * *

UNITED STATES PATENT AND TRADEMARK OFFICE

CERTIFICATE OF CORRECTION

PATENT NO. : 5,336,975
DATED : August 9, 1994
INVENTOR(S) : D.M. Goebel, et. al.

It is certified that error appears in the above-indentified patent and that said Letters Patent is hereby corrected as shown below:

Title page, item [54] and col.1, line 3, in the title, delete "CORROGATED" and insert instead --CORRUGATED--.

Column 9, line 58, delete "an" and insert instead --and--.

Column 10, line 1, delete "o" and insert instead--of--: and line 2, delete the first "of" and insert instead --for--.

Signed and Sealed this

Twelfth Day of September, 1995

*Attest:*

Bruce Lehman

BRUCE LEHMAN

*Attesting Officer*

*Commissioner of Patents and Trademarks*